US006280279B1

(12) United States Patent
Tanger et al.

(10) Patent No.: US 6,280,279 B1
(45) Date of Patent: Aug. 28, 2001

(54) SELF-ALIGNING WING

(75) Inventors: Jonathan Paul Tanger, Plantation; Morten L Tanger, Miami, both of FL (US)

(73) Assignee: Jonathan P. Tanger, Plantation, FL (US)

( * ) Notice: Subject to any disclaimer, the term of this patent is extended or adjusted under 35 U.S.C. 154(b) by 0 days.

(21) Appl. No.: 09/524,431

(22) Filed: Mar. 13, 2000

(51) Int. Cl.[7] ..... A63H 27/18
(52) U.S. Cl. ..... 446/34; 446/88; 446/114
(58) Field of Search ..... 446/34, 88, 93, 446/108, 114

(56) References Cited

U.S. PATENT DOCUMENTS 2,195,695 * 4/1940 Daniel ..... 446/34
2,348,920 * 5/1944 Ott ..... 446/34 X
2,560,742 * 7/1951 Reder ..... 446/34
3,232,002 * 2/1966 Harrison ..... 446/34
3,273,281 * 9/1966 Harrison ..... 446/34

FOREIGN PATENT DOCUMENTS

2613137 * 10/1977 (DE) ..... 446/34

* cited by examiner

*Primary Examiner*—John A. Ricci
(74) *Attorney, Agent, or Firm*—Marvin A. Naigur

(57) ABSTRACT

A self-aligning wing structure and method of assembly utilizes a main spar formed with spaced apart notch openings. The main spar is positioned on a substantially flat surface for receiving a plurality of ribs formed with leading edge slot openings and trailing edge slot openings. A leading edge core member is slid into the rib leading edge slot openings and a trailing edge core member is slid into the rib trailing edge slot openings. Accordingly, it is possible to achieve a self-aligning aerodynamic wing structure in accordance with the present invention.

14 Claims, 7 Drawing Sheets

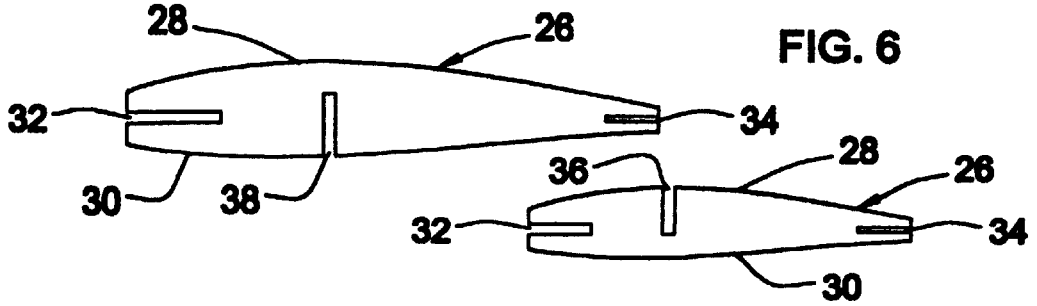
FIG. 6
FIG. 7
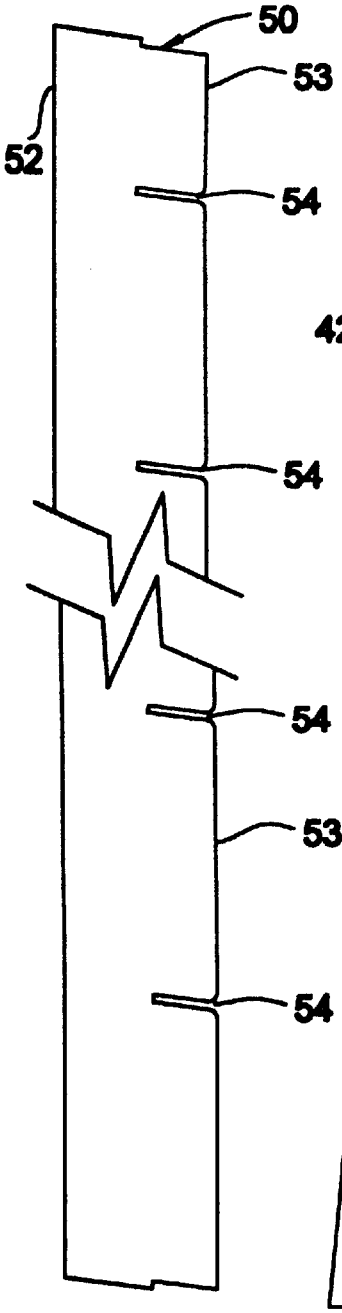
FIG. 8
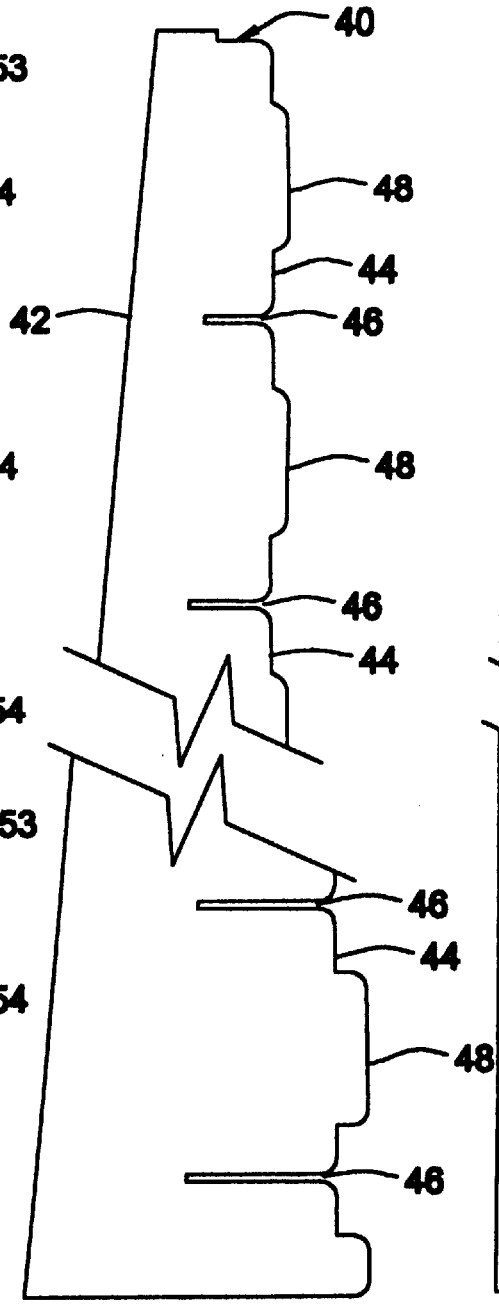
FIG. 9
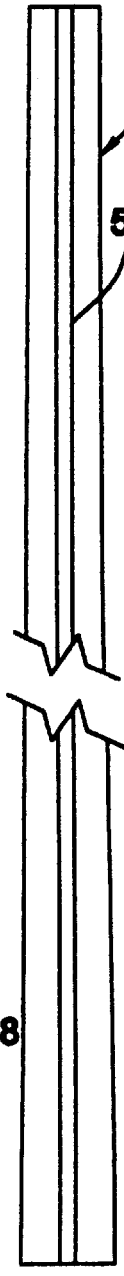
FIG. 10
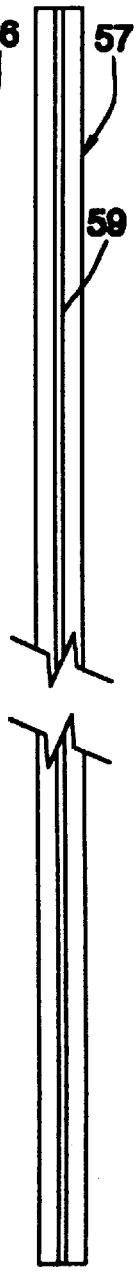

SELF-ALIGNING WING

BACKGROUND OF THE INVENTION

The present invention relates to a wing structure and method of assembling the wing structure, and more particularly to a wing structure in which the components can be slid into place without substantially employing any external fastening or clamping means.

Although many different types of wing constructions have been used in the building of model airplanes, these usually require clamping and/or gluing of individual components that are most commonly formed from balsa wood. This usually entailed gluing flat ribs to a central spar member and thereafter gluing leading edge and trailing edge members to the respective leading and trailing edges of the ribs. In addition to being tedious and time consuming, the glued wing structure of the prior art often resulted in a final wing assembly that was not accurate in accordance with the drawings and specifications supplied by the manufacture of the model airplane kit. The accuracy of wing construction in the assembly of model airplanes has become very important with the advent of model airplane designs, which now closely replicate the actual aircraft designs that the model has been derived from. The model airplane kits of today are usually produced from computer controlled laser cutting machines that produce accurate component parts that meet very exacting specifications. Accordingly, these new laser manufacturing techniques, together with the advent of sheathing the exterior with plastic type skin and providing modern solid state radio controls, has resulted in model airplanes that can reach speeds of over a hundred miles per hour with maneuverability that equals or even surpasses the actual aircraft from which the model airplane has been derived. Thus, the importance of accurate wing construction achieved by the present invention is greatly magnified when operating model airplanes at high speeds with greater maneuverability, and even small changes from the specifications in the assembled model wing could result in very poor flight performance of the respective model airplane. The present invention provides for ease of assembly of model wings that are very accurate with respect to the specifications and drawings, whereby an aerodynamic self-aligning wing structure can be readily achieved.

The unique main spar design of the present invention affords several additional advantages, one of which is the ability to use it with conventional prior art structural members, such as leading edge and trailing edge strips which are glued to the respective leading rib edges and trailing rib edges in the usual manner. The other advantage achieved through the main spar of the present invention, is the amelioration or even complete elimination of what is commonly known in the art as "wing tip stall" which as used herein means preventing stalling in the wing tip location prior to the rest of the wing structure, which increases as the angle of attack of the wing increases. By varying the angle of the slots in the ribs at the wing tip location, it is possible to rotate the wing tip in a downward direction and provide a uniformly tilted wing tip. Thus, the wing tip will have greater lift than the remainder of the wing, whereby the entire wing will have a more uniform stall characteristic. This is commonly known in the art as "wing tip washout" wherein the wing tip does not prematurely stall. Also, the uniformly tilted wing tip of the present invention, eliminates the need for the use of the prior art use of jigs and/or sheathing commonly used to twist the wing tip downwardly, which often resulted in creating unwanted non-uniformity and constraining forces on the wing structure.

By providing a design and method in accordance with the present self-aligning wing construction, it is possible to slide all of the major wing components into place, such that an aerodynamic wing structure has been achieved prior to gluing of the component parts from which the wing is comprised. In this manner, the wing structure, which has been slid together, can be glued along the abutting edges of the component parts without disturbing their location and causing misalignment. Thus, the gluing is not relied upon for positioning the wing components of the present invention but only to hold them together, wherein the glue merely strengthens the self aligning wing structure without changing the aerodynamic shape of the wing.

SUMMARY OF THE INVENTION

In accordance with illustrative embodiments demonstrating features and advantages of the present invention, there is provided a structure and method of assembling a self-aligning wing. The model airplane wing structure includes a main spar formed with spaced apart notch openings. A plurality of ribs are provided, each of which is formed with a center notch opening for mounting on the main spar, a leading edge slot opening and a trailing edge slot opening, with the ribs mounted on the main spar. A leading edge core member is formed with a plurality of spaced-apart notch openings positioned to engage the leading edge slot openings on the ribs, and the leading edge core member is mounted on the leading edge slot openings on the ribs. A trailing edge core member is formed with a plurality of spaced apart notch openings positioned to engage the trailing edge slot openings on the ribs, and the trailing edge core member is mounted on the trailing edge slot openings on the ribs. The angles of the front and center notches formed in the wing tip area of the ribs are varied to obtain a uniform downwardly tilted wing tip.

The method of assembling the model airplane wing of the present invention comprises positioning the main spar on a substantially flat work surface. A plurality of the ribs is mounted on the main spar, with the notch openings of the ribs engaging the notch openings of the main spar. The leading edge core member is slid onto the ribs such that the leading slots are received and clamped in the leading edge notches, and the trailing edge core member is slid onto the ribs such that the trailing edge slots are received and clamped in the trailing edge notches. In this manner an aerodynamic wing structure is assembled in accordance with the present invention.

BRIEF DESCRIPTION OF THE DRAWINGS

The above brief description, as well as further objects, features, and advantages of the present invention, will be more fully appreciated by reference to the following detailed description of presently preferred but nonetheless illustrative embodiments in accordance with the present invention, when taken in connection with the accompanying drawings wherein:

FIG. 6 is an enlarged elevational view of two of the ribs shown in FIG. 2, which have been, removed from the main spar in order better to show their construction;

FIG. 7 is an enlarged elevational view of the trailing edge core shown in FIG. 4 with the middle portion broken away;

FIG. 8 is an enlarged elevational view of the leading edge core shown in FIG. 4 with the middle portion broken away;

FIG. 9 is an enlarged elevational view of the leading edge member with the middle portion broken away;

FIG. 10 is an enlarged elevational view of the trailing edge member with the middle portion broken away;

DESCRIPTION OF THE PREFERRED EMBODIMENTS

Figure 1:
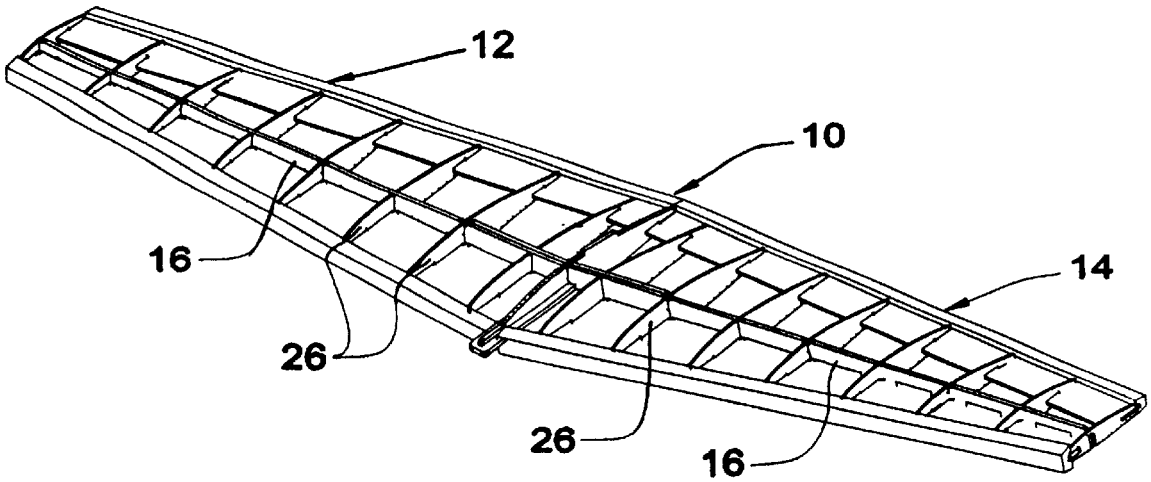
FIG. 1 is a perspective view of the complete wing construction of the present invention comprised of a left wing section and a right wing section, with the exterior skin removed to better show the internal wing construction in accordance with the present invention.

With reference to FIG. 1 a model airplane wing construction is generally referred to by the reference numeral 10, which is comprised of a right wing section 12 that is joined to a left wing section 14. Since the right wing section 12 is the mirror image of, and identical to, the left wing section 14, the description of the present invention and the drawings exclusive of FIGS. 1, 11, 12 and 13 have been directed to the right wing section 12. However, it should be understood that the individual wing components as best shown in FIGS. 2 through 10 could be utilized to form the right wing section 12 as well as the left wing section 14. By means of the components shown in FIGS. 11, 12 and 13, as will be more fully described herein, the right wing section 12 is connected to the left wing sectional to form the wing construction 10.

Figure 3:
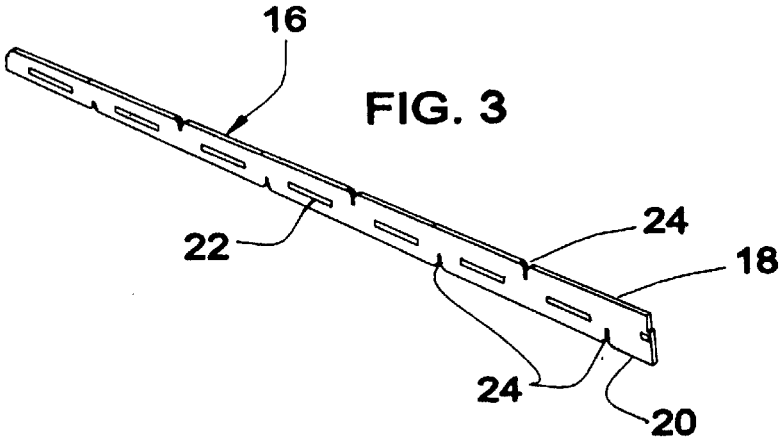
FIG. 3 is a perspective view of the main spar shown in FIG. 2 to better show the notch openings on the main spar.

Turning to FIG. 3, there is shown a main spar 16 defined by an upper edge 18, lower edge 20, and spaced apart elongated slots 22 are formed on the main spar 16 between upper edge 18 and lower edge 20. A series of notch openings 24 are formed on main spar 16 along the upper edge 18 and lower edge 20. As can be seen in FIG. 3, the notch openings 24 on upper edge 18 are positioned spaced apart an equal distance from the notch openings on lower edge 20. As will be more fully described herein, this alternating alignment of the notch openings 24 allows for ease of assembly, as well as stronger construction, and it is also possible to incorporate the main spar 16 into conventional wing designs of the prior art, whereby many of the advantages of the present invention can be achieved.

Figure 4:
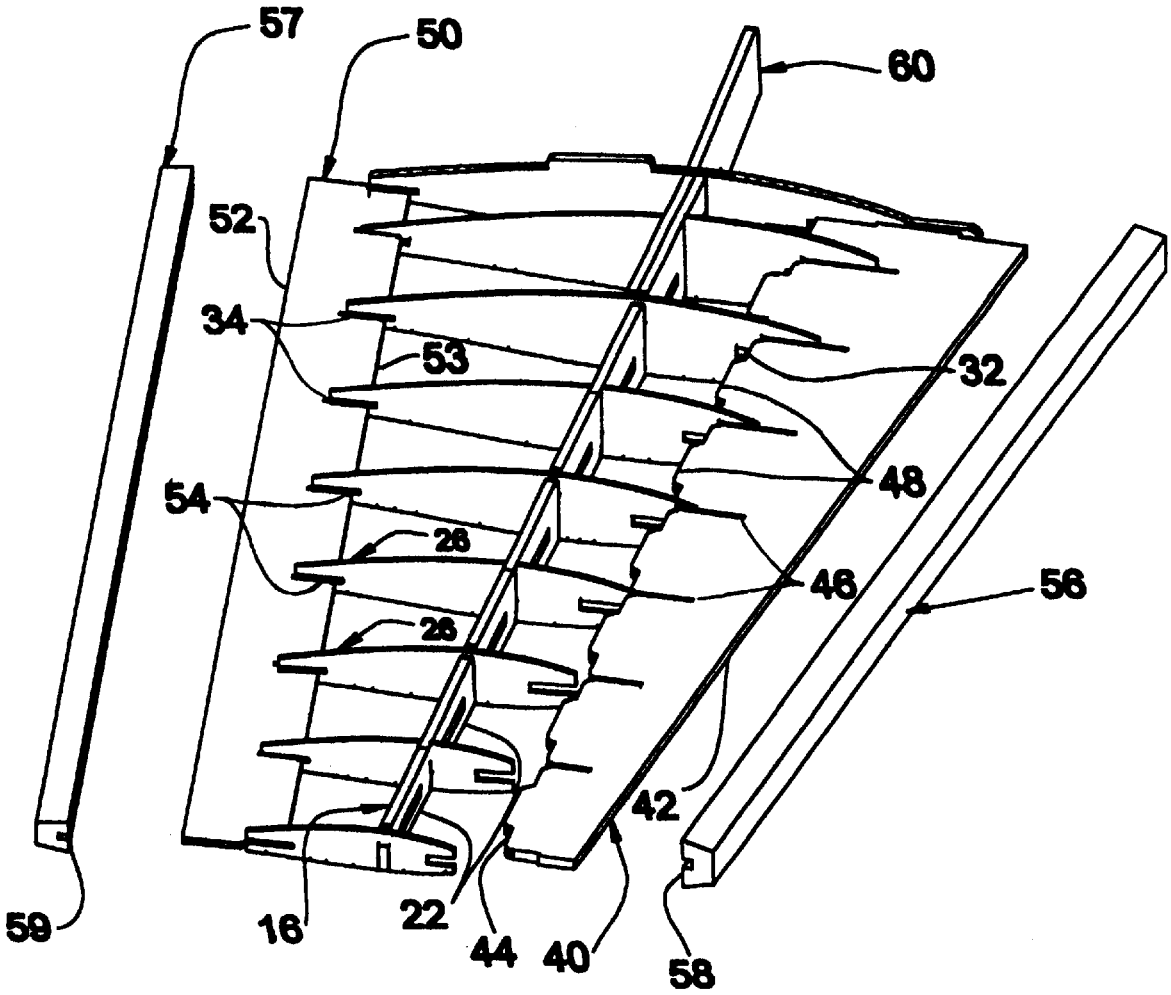
FIG. 4 is an enlarged exploded perspective view of the right wing section of FIG. 1, in which the component parts are positioned and aligned prior to assembly to better understand the wing construction and method of assembly of the present invention.
Figure 5:
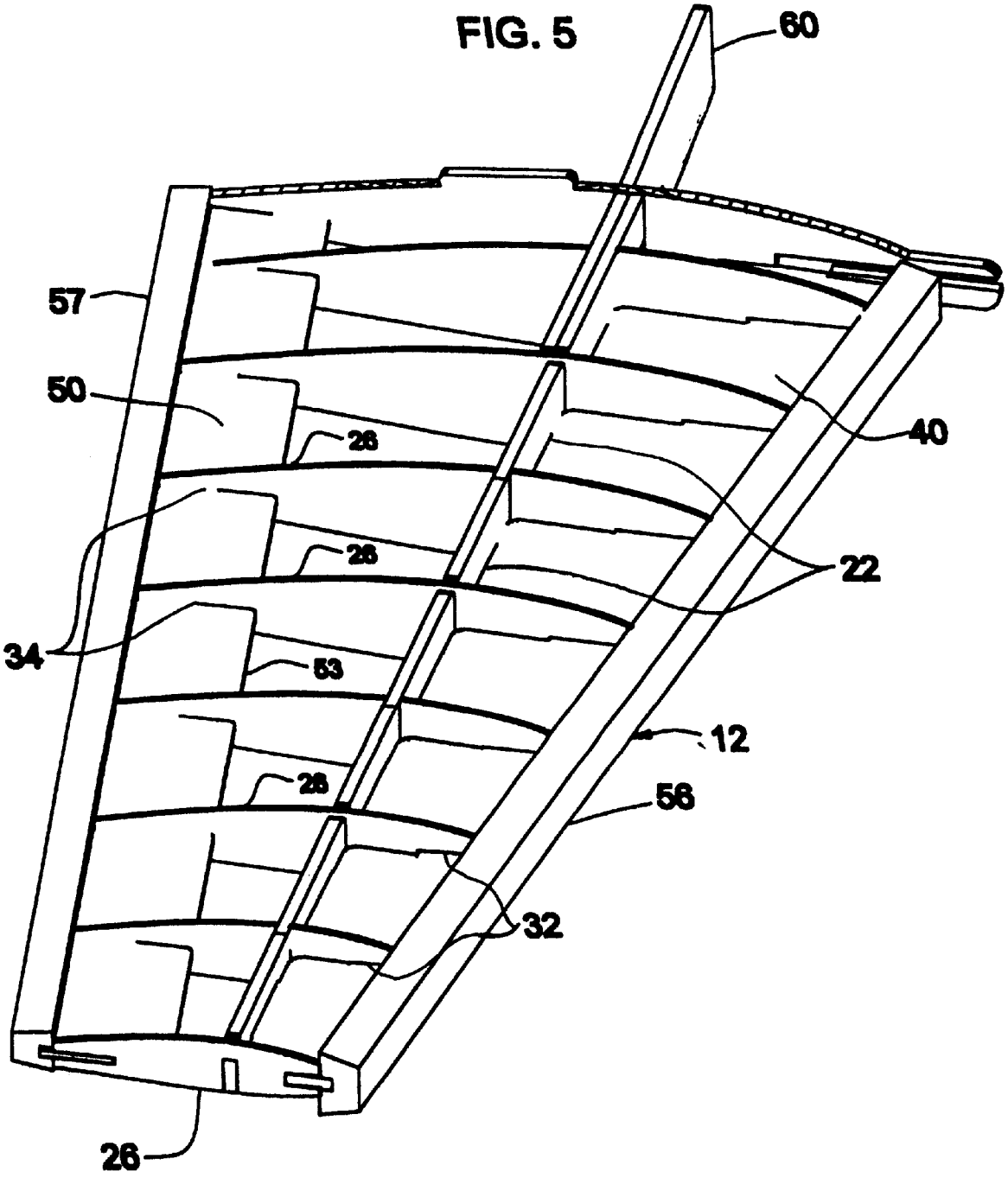
FIG. 5 is a perspective view of the wing section shown in FIG. 4 with the component parts of the wing section being slid into place.

By referring to FIGS. 6 through 10, there is shown the remaining individual component parts of the right wing section 12. Accordingly, in FIG. 6 there is shown two ribs 26 which differ in size to better illustrate the gradual decreasing size of the ribs 26, as best shown in FIGS. 4 and 5. However, it should be understood that it is also possible and common to produce model airplane designs with ribs 26 that are all of the same size, such that an aerodynamic wing structure is achieved. Each individual rib 26 is defined by an upper accurate edge 28, lower edge 30, leading edge notch 32, and trailing edge notch 34. As seen in FIG. 4 the ribs increase in size extending inward from the wing end tip, and medial slot openings 36 and 38 are alternately formed on upper accurate edge 28 and lower edge 30. Thus, substantially half of the ribs 26 are formed with upper medial slot openings 36, which extend from the upper accurate edge 28 towards the center of rib 24 and lower medial slot openings 38, which extend from lower edge 30 towards the center of rib 24. By providing upper medial slot openings 36 and lower medial slot openings 38 that are alternately positioned respectively on adjacent ribs 26, from upper accurate edge 28 to lower edge 30, the ease of assembly and enhanced strength of wing sections 12 and 14 are achieved. As best shown in FIG. 8, a leading edge core 40 is formed with a leading edge 42 and rearward edge 44 with spaced apart notch openings 46 extending from rearward edge 44 toward leading edge 42. Forming tabs 48 on rearward edge 44, between adjacent notch openings 46, completes the leading edge core 40.

In FIG. 7, the trailing edge core 50 is shown and defined by a trailing edge 52 and forward edge 53, with spaced apart notch openings 54 extending from forward edge 53 towards trailing edge 52.

In FIGS. 9 and 10 there is shown a leading edge support member 56 and trailing edge support member 57, which have been rotated ninety degrees with respect to the orientation of the leading edge core 40 and trailing edge core 50, which are respectively shown in FIGS. 7 and 8. The leading edge support 56 is formed with an elongated slot 58, and trailing support member 57 is formed with an elongated slot 59.

Figure 2:
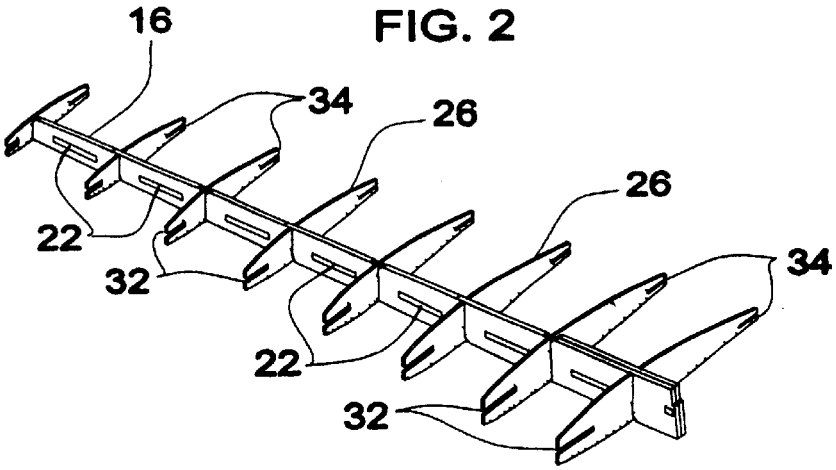
FIG. 2 is a perspective view of the main spar and ribs of the right wing section of the wing construction shown in FIG. 1.

By progressively inspecting FIGS. 4 and 5, the construction and method of assembly of the wing section 12 can be more fully appreciated. Accordingly, in FIG. 4 the main spar 16 and ribs 26 are joined together and the remaining major components of the wing section 12 are shown in a spaced apart position prior to being joined together to form the completed wing section 12 of FIG. 5. Thus, in FIG. 4 the leading edge core 40 is moved rearward onto the ribs 26 by sliding the notch openings 46 into the leading edge slots 32, such that the tabs 48 engage the elongated slots 22. In a similar manner, the trailing edge core 50 is moved forward onto the ribs 26 by sliding the notch openings 54 into the trailing edge slots 34. By sliding the elongated slot 58 of leading edge support member 56 onto leading edge 42 and by sliding the elongated slot 59 of trailing edge support member 57 onto trailing edge core 52, the assembly of wing section 12 has been essentially completed. However, it should be understood that it is possible to employ the main spar 16 and ribs 26, as best shown in FIG. 2, in conventional wing designs used in the prior art without utilizing the leading edge core support 40 and trailing edge core support 50. This could be accomplished by eliminating the leading edge notches 32 and trailing edge notches 34, and thereafter proceeding with the usual structure available in the prior art, such as by gluing a leading edge stick member and trailing edge stick member to the leading edges and trailing edges of ribs 26, respectively.

Figure 12:
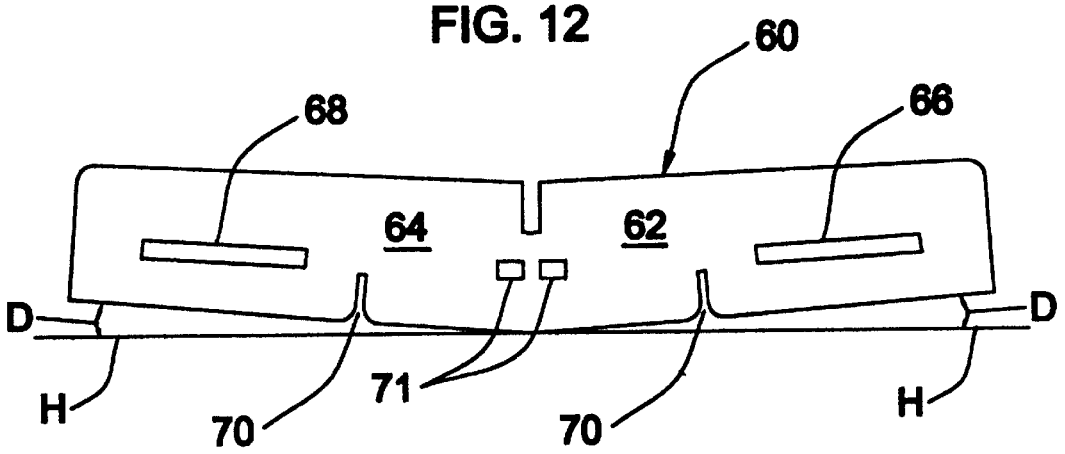
FIG. 12 is an enlarged elevational view of the dihedral brace shown in FIG. 4.

As best shown in FIG. 12, in order to join the wing sections 12 and 14 into the complete wing construction 10, there is provided a dihedral brace 60, which includes a right dihedral blade 62 and left dihedral blade 64. The right dihedral blade 62, is formed with an elongated slot 66, and left dihedral blade 64 is formed with an elongated slot 68. By forming the dihedral brace 60 with the right blade 62 and left blade 64 tilting upward from the center of dihedral brace 60, it is possible to achieve upward tilted positioning of the right wing section 12 and left wing section 14. On the central portion of dihedral brace 60, two square slots 71 are formed, one on forward blade 62 and the other on rearward blade 64. As shown in FIG. 12, the dihedral angles D are the two equal included angles between the horizontal lines H and the lower edge of forward blade 62 and rearward blade 64. The dihedral angle D varies with each specific aircraft design. In order to ensure the assembly of the right wing section 12 with the precise dihedral angle D specified for an aircraft design, the elongated slots 66, 68 are sized to be identical to the elongated slots 22 on main spar 16, and the lower medial slot openings 70 are formed at the bottom edge of blades 62, 64 which are sized to conform to the notch opening 34 at the end of the main spar 16 forming wing sections 12, 14.

In securing the right wing section 12 to the left wing section 14, the dihedral brace 60 is coextensively positioned on main spar 16 with slots 68 overlying slots 22 and lower slot opening 70 overlying notch opening 24. By aligning slot openings 68 and 22, as well as slot openings 70 and 24, it is possible to precisely position the location of dihedral brace 60 on the main spar 16, and fastening means, preferably glue, is applied between the coextensive surfaces of dihedral brace 60 and main spar 16, whereby the correct dihedral angle D has been achieved. In a similar manner to mounting the right wing section 12 to dihedral brace 60, the left wing section 14 is coextensively positioned on main spar 16 with slots 66 coextensive with slots 22 and lower slot opening 70 coextensive with notch opening 24. By aligning slot openings 66 and 22, as well as slot openings 70 and 38, it is possible to precisely establish the location of dihedral brace 60 on the main spar 16, and glue is preferably applied between the coextensive surfaces of dihedral brace 60 and main spar 16, whereby the correct dihedral angles D have been achieved.

Figure 11:
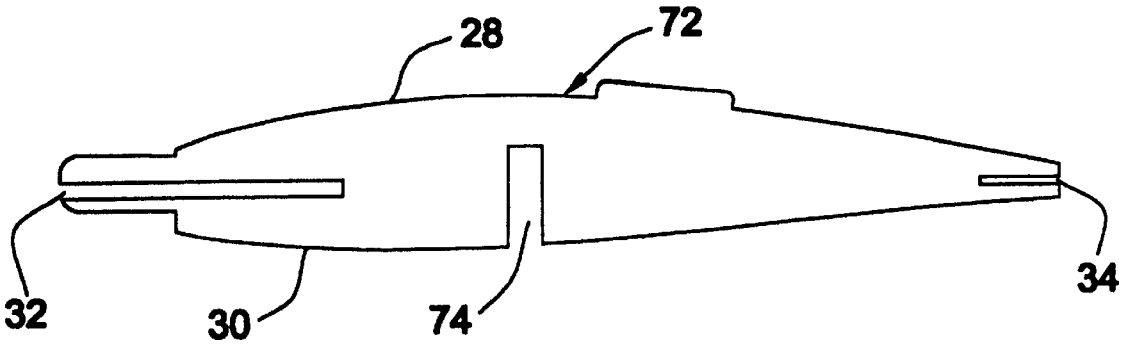
FIG. 11 is an enlarged elevational view of the center rib shown in FIG.4.

In FIG. 11, there is shown a main rib 72, which is somewhat different in shape than the ribs 26, but main rib 72 is similar to ribs 26 in that it is defined by a substantially similar upper accurate edge 28, lower edge 30, leading edge slot 32 and trailing edge slot 34. There is only one main rib 72 provided for each wing construction 10, and the lower edge 30 is formed with a lower medial slot opening 74 that is approximately twice the thickness size of lower medial slot opening 38,such that the slot openings 74 can accommodate the thickness of both the dihedral brace 60 and the main spar 16.

Figure 13:
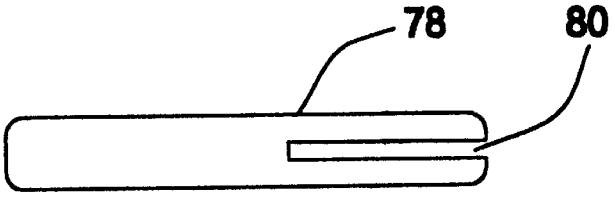
FIG. 13 is an enlarged elevational view of the wing mount shown in FIG. 1.

As shown in FIG. 13, a wing mount 78 in the form of an elongated flat member is provided with an elongated slot 80, which is sized to slide into leading edge slot 32 of the main rib 72. In this manner the two leading edge members of slot 80 slide into the two square slots 71 when slot 80 is slid into slot 32 of main rib 72. Thus, the right wing sectional and left wing section 14 are additionally held together by gluing the bottom leading edges of wing mount 78 to the upper surfaces of the leading edge cores 40 of the right wing section 12 and left wing section 14, such that the unitary wing construction 10 has been achieved.

Figure 14:
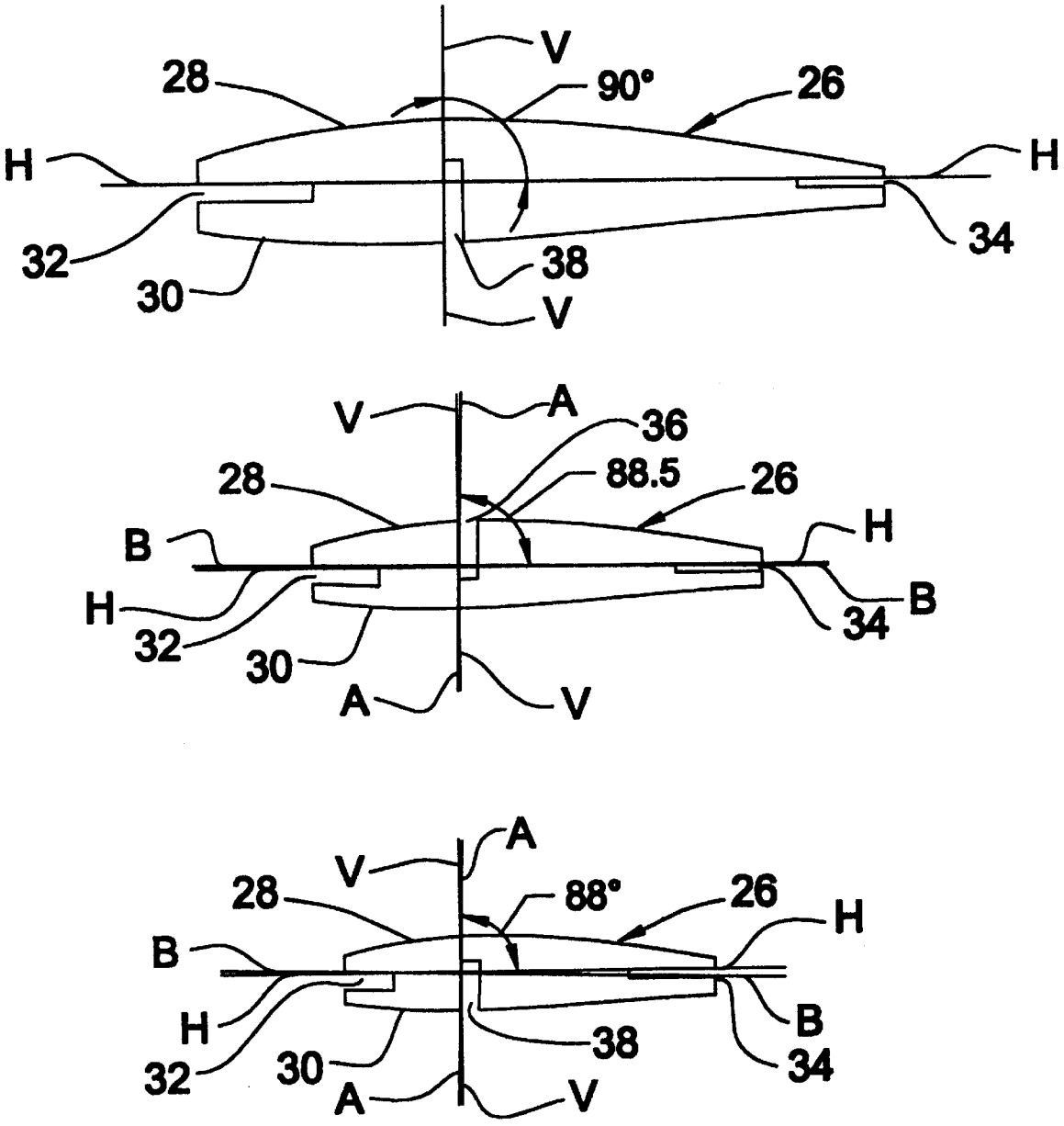
FIG. 14 is an enlarged elevational view of a standard notched rib which is compared with an angled notched rib of the tilted wing tip design.
Figure 15:
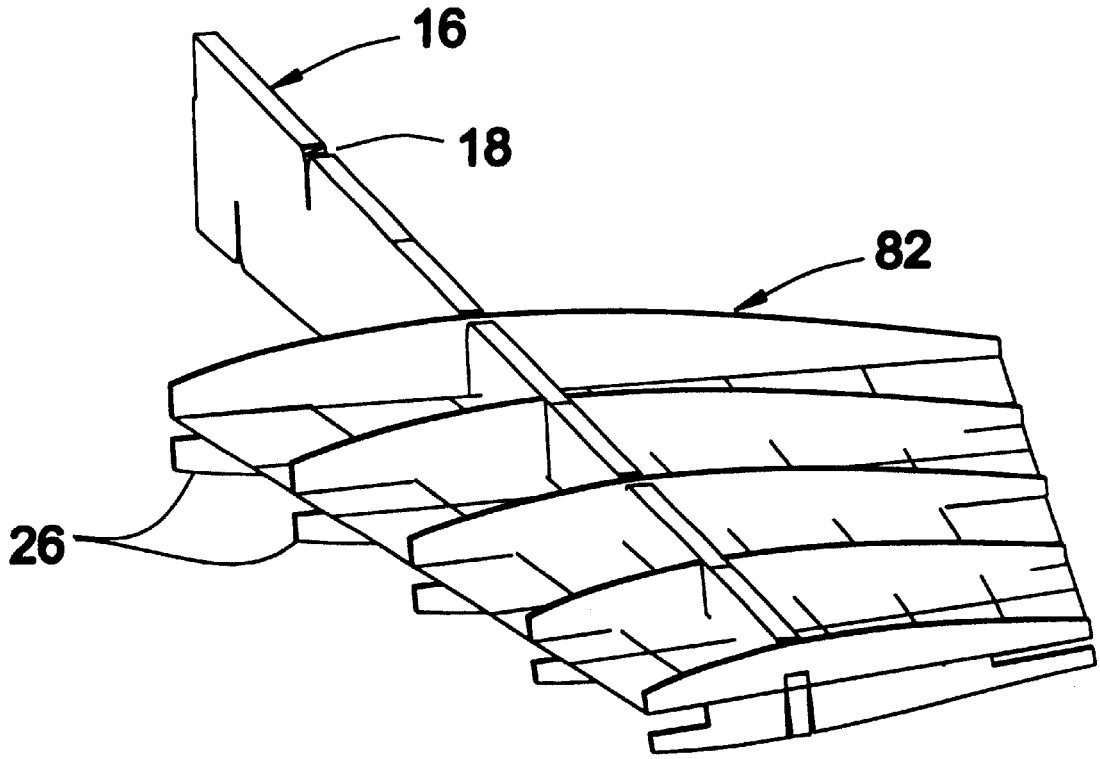
FIG. 15 is a perspective view of the tilted wing tip design showing the varying angles required to obtain a uniform tilted wing tip.

Turning to FIGS. 14 and 15, there is shown the wing tip design generally designated by the reference numeral 82 for alleviating or preventing wing tip stall and creating wing tip wash out in accordance with the present invention. Thus, the wing tip 82 in accordance with the preferred embodiment of the invention shown in FIG. 15 is defined by the last four ribs 26 at the end of right wing section 12, but the length of the wing tip 82 can be varied in accordance with the aerodynamic design requirements. The positioning of medial slot openings 36, 38 and leading edge notch 32 on wing tip 82 is obtained by first drawing a center line H—H through trailing edge notch 34 and a vertical reference line V—V perpendicular to center line H—H. As seen in FIG. 14 the medial slot openings 36, 38 of wing tip 82 are located at precise angles ascribed between vertical reference line V—V and an angled line designate A—A. Similarly, the leading edge notch 32 of wing tip 82 is located at a precise angle ascribed between horizontal center line H—H and an angled line designated B—B. By progressively comparing the three ribs 26 of FIG. 14, it can be seen that the standard ribs 26 beyond wing tip 82 are provided with slot openings 36, 38 and notches 32 that are in alignment with the horizontal center lines H—H and vertical reference lines V—V and the following two ribs 26 of the wing tip 82 are aligned at 89.5 degrees and 89 degrees, with respect to horizontal center line H—H and vertical center line V—V. By adhering to a 0.5 degree increment decrease for each of the ribs 26 in the wing tip 82, it is possible to rotate the wing tip 82 in a downward direction with respect to the horizontal centerline of main spar 16. This results in the leading edge of wing tip 82 tilting downward and the trailing edge of wing tip 82 tilting upward, such that the aerodynamic lift of wing tip 82 is increased. While the 0.5 degree angle increment represents the preferred embodiment of the present invention, it is possible to provide different angle increments in accordance with the desired wing design. Thus, in accordance with the invention, the wing tip 82 will not stall prematurely before the main wing section has stalled, whereby the aerodynamic performance of the entire wing has been enhanced.

Additional modifications, changes and substitutions are intended in the foregoing disclosure, and, in some instances, some features of the invention will be employed without corresponding use of other features. Accordingly, it is appropriate that the appended claims be construed broadly and in a manner consistent with the spirit and scope of the invention herein.

What is claimed is:

1. A model airplane wing section comprising: a main spar formed with spaced-apart notch openings; a plurality of ribs, each of which is formed with a central slot opening for mounting on said main spar, a leading edge slot opening, and a trailing edge slot opening, and said ribs mounted on said main spar; a leading edge core member formed with a plurality of spaced-apart notch openings positioned to engage said leading edge openings on said ribs, and said leading edge core member mounted on the leading edge openings on said ribs; a trailing edge core member formed with a plurality of spaced-apart openings positioned to engage the trailing edge openings on said ribs, and said trailing edge core member mounted on the trailing edge openings on said ribs; whereby an aerodynamic wing structure is formed.

2. A model airplane wing section according to claim 1, in which the abutting edges of said main spar, ribs, leading edge core member, and trailing edge core member, are permanently joined together by glue means.

3. A model airplane wing section according to claim 1, in which said main spar is formed with a plurality of spaced-apart elongated slots, said leading edge core member formed with rearward located tabs configured for mounting in said slots; whereby said leading edge core member is held in place.

4. A model airplane wing section according to claim 3, in which said main spar, ribs, leading edge core member, and trailing edge core member are fabricated from balsa wood, and the edges of said main spar, ribs, leading edge core member, and trailing edge core member which abut each other are permanently joined together by glue means.

5. A model airplane wing section according to claim 4, in which said ribs are each formed with leading edge elongated slots and trailing edge elongated slots, said leading edge core member formed with elongated slots sized and spaced apart to correspond to said leading edge elongated slots on said ribs, and said trailing edge core member formed with elongated slots sized and spaced apart to correspond to said trailing edge elongated slots of said ribs, whereby said leading edge rib elongated slots slide into said leading edge core member elongated slots and said trailing edge rib elongated slots slide into said trailing edge core member elongated slots.

6. A model airplane wing section according to claim 3, in which said main spar consists of an elongated beam and said notches are alternately formed on the upper surface and lower surface of said elongated beam, and said ribs consist of flat members with an upper arcuate edge and lower straight edge with said ribs having alternately formed upper slots on said arcuate edge and lower slots on said straight edge, such that said ribs are capable of being alternately mounted on said arcuate edge and said straight edge.

7. A model airplane wing section according to claim 1, in which said ribs are each formed with notches and said main spar is formed with notches that are spaced apart to receive said notches on said ribs.

8. A model airplane wing section according to claim 1, in which a wing tip is comprised of a plurality of said ribs at the end of said wing section, each of said central slot openings of said wing tip formed at an angle that is less than a ninety-degree angle between the horizontal and vertical center line of said ribs, and said angle of each rib of said wing tip decreasing incrementally as said ribs are positioned to extend to the end of said wing tip, such that said wing tip is essentially rotated in a clockwise direction with respect to the horizontal centerline of said wing, whereby the aerodynamic lift created by said wing tip is increased.

9. A model airplane wing section according to claim 8, in which said wing tip is formed from at least four ribs, and said angle for the first wing tip rib is 89.5 degrees and each rib extending beyond said first wing tip rib toward the end of said wing tip decreasing an increment of 0.5 degrees.

10. A model airplane wing section including a main spar, a plurality of ribs mounted on said main spar, a leading edge member secured to the leading edge of said ribs, and a trailing edge member secured to the trailing edge of said ribs, the improvement comprising said ribs being formed with elongated notches, said main spar being formed with elongated notches that are spaced apart such that each notch on said main spar receives a notch on each of said ribs.

11. A model airplane wing section according to claim 10, in which said main spar consists of an elongated beam, and said notches are alternately formed on the upper surface and lower surface of said elongated beam, and said ribs consist of flat members with an upper arcuate edge and lower straight edge with said ribs alternately formed with upper slots on said arcuate edge and lower slots on said straight edge, such that said ribs are capable of being alternately mounted on said arcuate edge and said straight edge.

12. A method of assembling a model airplane wing section according to claim 10, in which glue is applied to the abutting surfaces of said main spar member, ribs, leading edge core member, and trailing edge core member, whereby permanent attachment has been achieved.

13. A method of assembling a model airplane wing section comprising the steps of: positioning a main spar member formed with spaced apart notch openings on a substantially flat surface; mounting a plurality of ribs having center notch openings on said main spar, such that the notch openings of said ribs engage the notch openings of said main spar; sliding a leading edge core member, formed with a plurality of spaced apart notch openings onto said ribs which have been formed with leading edge slots for receiving and clamping into said notch openings of said leading edge core member; sliding a trailing edge member, formed with a plurality of spaced apart notch openings onto said ribs which have been formed with trailing edge slots for receiving and clamping into said notch openings of said trailing edge core member, whereby an aerodynamic wing structure has been formed.

14. A model airplane wing section comprising a main spar having spaced notch openings, a plurality of ribs having elongated notches to engage the openings on said main spar, a leading edge member secured to the leading edge of said ribs, and a trailing edge member secured to the trailing edge of said ribs.

* * * * *